US010246650B2

(12) United States Patent
Sui et al.

(10) Patent No.: US 10,246,650 B2
(45) Date of Patent: Apr. 2, 2019

(54) CATALYTIC CRACKING FRACTIONATION AND ABSORPTION STABILIZATION SYSTEM, AND ENERGY SAVING METHOD THEREOF

(71) Applicants: Tianjin University, Tianjin (CN); Pei-Yang National Distillation Technology Corporation Limited, Tianjin (CN)

(72) Inventors: Hong Sui, Tianjin (CN); Zhen Han, Tianjin (CN); Xingang Li, Tianjin (CN); Jingyi Li, Tianjin (CN)

(73) Assignees: Tianjin University, Tianjin (CN); Pei-Yang National Distillation Technology Corporation Limited, Tianjin (CN)

( * ) Notice: Subject to any disclaimer, the term of this patent is extended or adjusted under 35 U.S.C. 154(b) by 0 days.

(21) Appl. No.: 15/524,614

(22) PCT Filed: Dec. 12, 2014

(86) PCT No.: PCT/CN2014/093746
§ 371 (c)(1),
(2) Date: May 4, 2017

(87) PCT Pub. No.: WO2016/074306
PCT Pub. Date: May 19, 2016

(65) Prior Publication Data

US 2017/0321132 A1 Nov. 9, 2017

(30) Foreign Application Priority Data

Nov. 12, 2014 (CN) ..... 2014 1 0635184

(51) Int. Cl.
*C10G 53/04* (2006.01)
*C10G 21/00* (2006.01)
(Continued)

(52) U.S. Cl.
CPC ..... *C10G 53/04* (2013.01); *C10G 5/04* (2013.01); *C10G 7/00* (2013.01); *C10G 7/02* (2013.01);
(Continued)

(58) Field of Classification Search
CPC ..... C10G 5/04; C10G 21/00; C10G 53/04; F25B 27/02
See application file for complete search history.

(56) References Cited

U.S. PATENT DOCUMENTS

2011/0240519 A1* 10/2011 Jan ..... B01J 38/30 208/70

* cited by examiner

*Primary Examiner* — Brian A McCaig
(74) *Attorney, Agent, or Firm* — George G. Wang; Bei & Ocean

(57) ABSTRACT

The present invention provides a catalytic cracking fractionation and absorption-stabilization system, and energy saving method thereof; the present invention is to arrange a waste heat refrigerator of the main fractionating tower, a waste heat refrigerator of rich gas and a waste heat refrigerator of stabilizer in a catalytic cracking fractionation and absorption-stabilization system so as to utilize low temperature waste heat at the top of a main fractionating tower, rich gas, stable gasoline, intermediate heat exchange flow of an absorber of the system as a refrigerator driving heat source; in order to cool naphtha and circulating gasoline to a low temperature lower than 40° C., control low temperature operations of the absorber and reduce the heat load of a desorber and a stabilizer, and the heat extracted by the refrigerators is cooled by cooling water with a higher temperature so as to reduce the consumption of the cooling water. In addition, developed residual pressure generating units and waste heat generating units coordinate to convert medium and low pressure of the dry gas and low-grade waste heat of other products in the system into electric
(Continued)

energy that can be conveyed into a grid, therefore the electricity consumption of a dry gas compressor can be supplemented, and the operation cost of the system is reduced to the minimum.

2 Claims, 1 Drawing Sheet

(51) Int. Cl.

| | |
|---|---|
| ***C10G 5/04*** | (2006.01) |
| ***F25B 27/02*** | (2006.01) |
| ***C10G 53/00*** | (2006.01) |
| ***C10G 7/02*** | (2006.01) |
| ***F01K 27/00*** | (2006.01) |
| ***F01K 27/02*** | (2006.01) |
| ***C10G 7/00*** | (2006.01) |
| ***C10G 11/00*** | (2006.01) |

(52) U.S. Cl.
CPC ..... *C10G 11/00* (2013.01); *C10G 21/00* (2013.01); *C10G 53/00* (2013.01); *F01K 27/00* (2013.01); *F01K 27/02* (2013.01); *F25B 27/02* (2013.01); *C10G 2400/02* (2013.01); *C10G 2400/04* (2013.01); *C10G 2400/28* (2013.01)

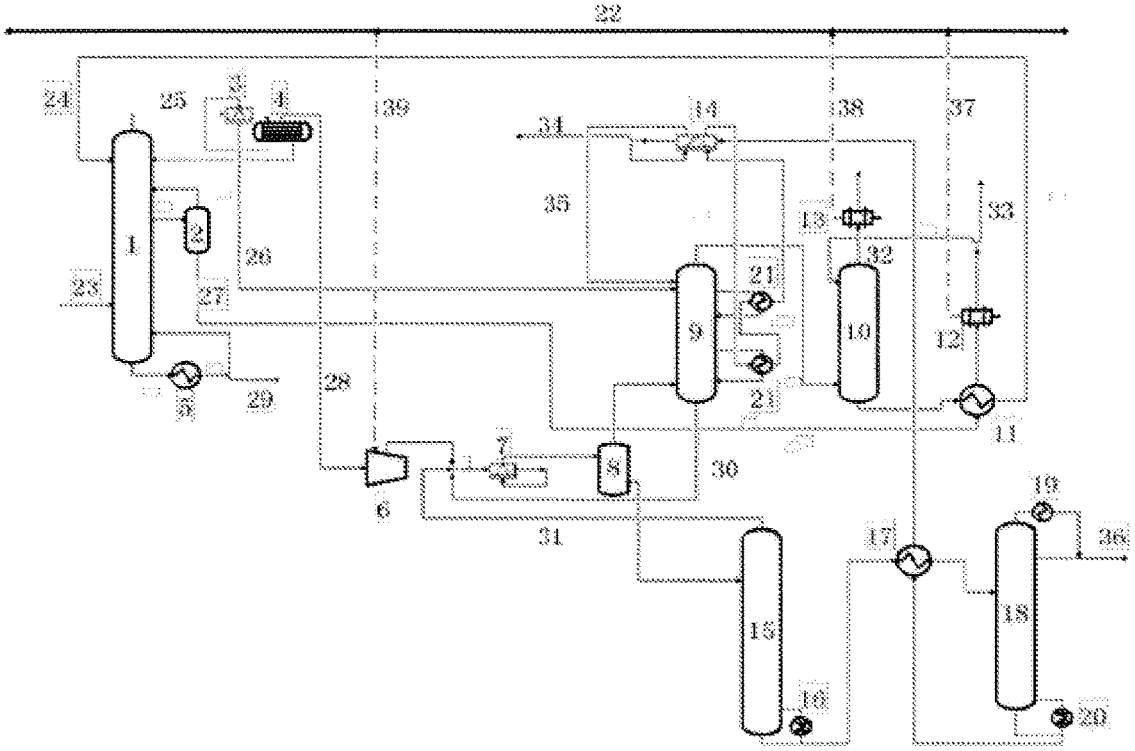
22
24
25
26
4
39
34
14
38
37
35
13
33
32
1
2
23
27
21
9
10
12
28
29
21
11
7
8
30
6
31
19
17
36
15
18
16
20

CATALYTIC CRACKING FRACTIONATION AND ABSORPTION STABILIZATION SYSTEM, AND ENERGY SAVING METHOD THEREOF

FIELD OF THE INVENTION

The present invention relates to a catalytic cracking fractionation and absorption-stabilization system of an oil refinery, and an energy saving method, and belongs to the technical field of chemical energy saving engineering. Energy saving of the system is achieved by waste heat and residual pressure utilization technology.

BACKGROUND OF THE INVENTION

A catalytic cracking unit is an important high energy consumption device of an oil refinery at present. A fractionation device cuts products from a catalytic cracking reactor into rich gas, naphtha, diesel oil, slurry and other rough products by using boiling point ranges. An absorption-stabilization system is a post-treatment process of the catalytic cracking unit. It is mainly composed of an absorber, a desorber, a reabsorber, a stabilizer, a corresponding heat exchanger and other auxiliary equipment. The device mainly aims at separating the naphtha and the rich gas produced by the fractionation device into stable gasoline with a qualified vapor pressure, dry gas and liquefied petroleum gas. The detailed separation process is as follows: compressing the rich gas, mixing the rich absorption oil with desorbed gas for gas-liquid balancing on the mixture in a gas-liquid balance tank, introducing the gas at the top of the balance tank into the bottom of the absorber, and introducing the naphtha at the bottom of the tank into the desorber; the top of the absorber discharges lean dry gas, and the gas passes through reabsorber by using light diesel oil as an absorbent to recycle gasoline components; the top of the reabsorber comes out dry gas, and the rich absorption oil at the bottom returns to a main fractionating tower, and the deethanization gasoline at the bottom of the desorber enters the stabilizer. The stabilizer evaporates light components lighter than C4 from the deethanization gasoline, and liquefied gas mainly containing C3 and C4 is obtained at the top; and the bottom product is the stable gasoline with the qualified vapor pressure and is cooled to 40° C., a part of the bottom product returns to the top of the absorber to serve as a supplementary absorbent, and the other part is discharged from the device as products. In order to improve the absorption efficiency of the absorber, the absorber in the absorption-stabilization system is generally provided with an intermediate reboiler for extracting heat at the middle to ensure low temperature absorption, and a large amount of cooled stable gasoline is circulated to the absorber to serve as the supplementary absorbent.

In view of the problems easily occurring to the system that the dry gas carries the liquefied gas and the energy consumption is higher and the like, the objective of the energy saving optimization of the technological process is to reduce the separation energy consumption of the system on the premise of guaranteeing the quality and the yield of the liquefied gas and the stable gasoline. Although a large quantity of studies, such as the patent CN102021033A "Enhanced Mass Transfer And Efficient Energy-Saving Absorption-stabilization System", and the literature "Development Of Energy Saving Process Of Absorption-stabilization System", describe such methods to optimize the heat input and circulating water consumption of the absorption-stabilization system as two-stage condensation process, double-strand feeding method, intermediate reboiler process and the like, most of the currently developed methods cannot reduce the absorption temperature of the absorber due to the limitations of the use temperature of circulating water and energy consumption considerations, and thus the reachable energy saving effects are relatively limited. Studies show that the bottleneck of the energy saving method of the system depends on the feeding temperature of the absorber and the intermediate heat extraction temperature, if the feeding temperature and the intermediate heat extraction temperature are reduced, the dosage of the supplementary absorbent can be greatly reduced on the premise of guaranteeing the absorption effect, that is, a large amount of used stable gasoline is circulated in the system.

In view of the above situations, the present invention on the basis of the optimization of catalytic cracking fractionation and absorption-stabilization process parameters, in combination with waste heat refrigeration, residual pressure power generation, waste heat generation and other energy utilization technology, the waste heat of the system itself is used for refrigeration of a driving heat source, the absorption temperature of the absorption process is reduced to lower than 40° C. to reduce the dosage of the circulating absorbent, therefore the heat input, the electrical input and the cooling water consumption of the system can be reduced, and the discharge of a part of waste heat of the system is avoided, which has great significance for the energy saving, emission reduction and industrialization of the catalytic cracking unit.

SUMMARY OF THE INVENTION

The method of the present invention is to arrange a waste heat refrigerator of the main fractionating tower, a waste heat refrigerator of rich gas and a waste heat refrigerator of stabilizer in a catalytic cracking fractionation and absorption-stabilization system so as to utilize low temperature waste heat at the top of a main fractionating tower, rich gas, stable gasoline, intermediate heat exchange flow of an absorber of the system as a refrigerator driving heat source, in order to cool naphtha and circulating gasoline to a low temperature lower than 40° C., control low temperature operations of the absorber and reduce the heat load of a desorber and a stabilizer, and the heat extracted by the refrigerators is cooled by cooling water with a higher temperature so as to reduce the consumption of the cooling water. In addition, developed residual pressure generating units and waste heat generating units coordinate to convert medium and low pressure of the dry gas and low-grade waste heat of other products in the system into electric energy that can be conveyed into a grid, therefore the electricity consumption of a dry gas compressor can be supplemented, and the operation cost of the system is reduced to the minimum.

The technical solution of the present invention is as follows:

A catalytic cracking fractionation and absorption-stabilization system of an oil refinery comprises: heat is extracted from the top of a main fractionating tower 1 by a waste heat refrigerator to serve as a refrigerator driving heat source for cooling naphtha; rich gas 28 at the top of the main fractionating tower enters into a compressor for compression, the compressed rich gas is mixed with rich gasoline 30 discharged from the bottom of an absorber and desorbed gas 31 discharged from the top of a desorber, and the mixture enters into a gas-liquid separation tank 8 to reduce the phase splitting temperature therein after being cooled in a waste heat refrigerator; a diesel oil tower 2 is arranged on the siding of the main fractionating tower 1, after the diesel oil discharged from the bottom of the diesel oil tower 2 exchanges heat with a diesel oil heat exchanger 11, the residual waste heat is used for generating power by a waste heat generator; in an absorption-stabilization system, two absorber intermediate heat exchangers 21 serially connected are arranged on each side of an absorber 9 and are serially connected with the waste heat refrigerator that is driven by the waste heat of the stable gasoline by pipelines so as to extract the heat discharged by the absorber in time during absorption and control low temperature absorption of the absorber; a residual pressure generator is connected to the top of a reabsorber 10 to generate power by the medium and low residual pressure of dry gas 32 at the top; a liquid phase at the bottom of a stabilizer 18 preheats the feedstock by a feedstock heat exchanger and is entered into the waste heat refrigerator, a part of the discharge is extracted as product gasoline 34, and the other part enters the waste heat refrigerator to be refrigerated and cooled and returns to the top of the absorber from the waste heat refrigerator to serve as circulating gasoline 35; and the electricity generated by the residual pressure generator and the electricity generated by the waste heat generator are respectively conveyed into a grid by electric wires, and the power supply used by the compressor is led out from the grid by an electric wire.

According to an energy saving method for the catalytic cracking fractionation and absorption-stabilization system of the oil refinery of the present invention, a catalytic cracking reaction product 23 and rich diesel oil 24 returning from the bottom of the reabsorber 10 introduce into the main fractionating tower 1 for oil cutting according to different boiling point ranges, heat is extracted from top oil gas 25 by a waste heat refrigerator 3 of the main fractionating tower to serve as a refrigerator driving heat source, the top oil gas enters into a naphtha tank 4 after being cooled within the temperature ranges from 40 to 80° C., the liquid phase in the tank is naphtha, a part of the naphtha returns to the tower as backflow, the other part of the naphtha is cooled by the waste heat refrigerator 3 of the main fractionating tower, and naphtha 26 is cooled within the temperature ranges from solidifying point to 40° C. and then enters into the top of the absorber 9; the rich gas 28 is discharged from the naphtha tank 4 and is pressurized within the pressure ranges from 0.1 to 3 Mpa in a compressor 6, the electricity is led out by a compressor power supply 39 from a grid 22, and the compressed rich gas is mixed with the rich gasoline 30 at the bottom of the absorber and the desorbed gas 31 at the top of a desorber 15; a mixed gas-liquid phase enters into a waste heat refrigerator 7 of rich gas to exchange heat within the temperature ranges from solidifying point to 40° C., the rich gas separated by the gas-liquid separation tank 8 enters into the absorber 9 from the bottom, the operating pressure of the absorber 9 is within the pressure ranges from 0.8 to 2.6 Mpa, the naphtha and the circulating gasoline at the tower top mainly absorb C3, C4 components in the rich gas, and the two absorber intermediate heat exchangers 21 serially connected on the side edge of the tower extract heat from the siding so as to keep the low temperature absorption of the absorber at the temperature ranges from 5 to 80° C.; light components containing the gasoline enter into the reabsorber 10 and are absorbed by the circulating diesel oil, the operating pressure of the reabsorber 10 is within the pressure ranges from 0.8 to 2.6 Mpa, the dry gas 32 is pressurized by a residual pressure generator 13 to the atmospheric pressure to be discharged, and the electricity generated by the residual pressure generator 13 is conveyed into a grid 22 by a power supply 38 of residual pressure power generation; diesel oil containing rich gasoline components is discharged from the bottom of the reabsorber 10, exchanges heat with diesel oil 27 through the diesel oil heat exchanger 11 to be heated within the temperature ranges from 150 to 250° C., and is circulated to the top of the main fractionating tower 1 as rich diesel oil 24; the diesel oil tower 2 is arranged on the siding of the main fractionating tower 1, light components are removed from the liquid phase extracted from the side of the main fractionating tower by the refining of the diesel oil tower 2, after the diesel oil 27 extracted from the bottom of the diesel oil tower 2 is cooled to 80-150° C. by the heat exchange with the diesel oil heat exchanger 11, the temperature is still high, so the diesel oil can be used as the waste heat source of a waste heat generator 12, the generated electricity is conveyed into the grid 22 by a power supply 37 of waste heat power generation to supplement the power consumption, the diesel oil after heat extraction is cooled down to 40° C., a part of the diesel oil is circulated to the reabsorber, and the rest part is extracted as product diesel oil 33.

The liquid phase separated from the gas-liquid separation tank 8 enters into the desorber 15 for separating the dry gas light component in the liquid phase and separating C2 and C3, C4 components, the operating pressure of the desorber 15 is within the pressure ranges from 0.4 to 1.6 MPa, the light component desorbed gas 31 is mixed with compressed gas, heavy components serving as feedstock enter into the stabilizer 18 to separate liquefied petroleum gas and gasoline components, the operating pressure of the stabilizer 18 is within the pressure ranges from 1 to 1.8 MPa, a product of liquefied petroleum gas 36 is discharged from the top, stable gasoline at the bottom enters into a feedstock heat exchanger 17 for preheating, and heat is extracted from the same by a waste heat refrigerator 14 of stabilizer, a part of the stable gasoline is extracted as product gasoline 34, the rest is cooled by the waste heat refrigerator 14 of stabilizer to the temperature ranges from solidifying point to 40° C. and is circulated to the absorber 9 as the circulating gasoline 35, the waste heat refrigerator 14 of stabilizer extracts heat to drive the refrigeration, the refrigerating capacity is relatively large, which is capable of cooling the circulating gasoline 35 and the absorber intermediate heat exchangers 21 serially connected to the temperature ranges from solidifying point to 40° C. A slurry heat exchanger 5 is arranged at the bottom of the main fractionating tower 1, high-temperature slurry higher than 300° C. is cooled to about 250° C. by heat extraction, a part of the high-temperature slurry returns to the bottom of the main fractionating tower 1, and the rest is extracted as product slurry 29.

The present invention has the following advantages:

(1) Due to the development of the catalytic cracking fractionation and absorption-stabilization system, the inertial thinking of common engineering conditions is changed, the low temperature operation of the absorber lower than 40° C. is achieved, and the dosage of the circulating gasoline is greatly reduced, that is, the heat input of the system is reduced.

(2) The waste heat refrigeration device, the residual pressure power generation device and the waste heat power generation device used by the method can be low-temperature waste heat and medium and low residual pressure utilization devices which are singly developed for the operating parameters of the system, the applicable parameter range is wide, no process system is involved, and the quality of the dry gas, the stable gasoline and other products is stable.

(3) The system is expected to reduce the overall energy consumption of the original process system by 15-30%, the driving sources of the refrigeration and power generation devices are all waste heat and residual pressure discharged from the system, and the low-temperature waste heat discharged from the system to the environment is reduced by 20-30%, so that the economic benefits of enterprises are greatly improved on the premise of reducing the environmental pollution.

BRIEF DESCRIPTION OF THE DRAWINGS

FIG. 1 is a schematic diagram of an energy saving flow of a catalytic cracking fractionation and absorption-stabilization system.

In which:

main fractionating tower 1, diesel oil tower 2, waste heat refrigerator 3 of main fractionating tower, naphtha tank 4, slurry heat exchanger 5, compressor 6, waste heat refrigerator 7 of rich gas, gas-liquid separation tank 8, absorber 9, reabsorber 10, diesel oil heat exchanger 11, waste heat generator 12, residual pressure generator 13, waste heat refrigerator 14 of stabilizer, desorber 15, desorber reboiler 16, feedstock heat exchanger 17, stabilizer 18, stabilizer condenser 19, stabilizer reboiler 20, absorber intermediate heat exchanger 21, grid 22; catalytic cracking reaction product 23, rich diesel oil 24, oil gas 25, naphtha 26, diesel oil 27, rich gas 28, product slurry 29, rich gasoline 30, desorbed gas 31, dry gas 32, product diesel oil 33, product gasoline 34, circulating gasoline 35, liquefied petroleum gas 36, power supply 37 of waste heat power generation, power supply 38 of residual pressure power generation and compressor power supply 39.

DETAILED DESCRIPTION OF THE EMBODIMENTS

The present invention provides a catalytic cracking fractionation and absorption-stabilization system, and an energy saving method thereof. The present invention is illustrated by the following embodiments, but is not limited to the following embodiments. The present invention will be further described in detail combining with the drawings.

The catalytic cracking fractionation and absorption-stabilization system of an oil refinery of the present invention comprises: heat is extracted from the top of a main fractionating tower 1 by a waste heat refrigerator to serve as a refrigerator driving heat source for cooling naphtha; the rich gas 28 at the top of the main fractionating tower enters into a compressor for compression, and the compressed rich gas is mixed with rich gasoline 30 discharged from the bottom of an absorber and desorbed gas 31 discharged from the top of a desorber, and the mixture enters into a gas-liquid separation tank 8 to reduce the phase splitting temperature therein after being cooled in a waste heat refrigerator. A diesel oil tower 2 is arranged on the siding of the main fractionating tower 1, after the diesel oil discharged from the bottom of the diesel oil tower 2 exchanges heat with a diesel oil heat exchanger 11, the residual waste heat is used for generating power by a waste heat generator. In an absorption-stabilization system, two absorber intermediate heat exchangers 21 serially connected are arranged on each side edge of an absorber 9 and are serially connected with the waste heat refrigerator that is driven by the waste heat of the stable gasoline by pipelines so as to extract the heat discharged by the absorber during absorption and control low temperature absorption of the absorber. A residual pressure generator is connected to the top of a reabsorber 10 to generate power by the medium and low residual pressure of dry gas 32 at the top. A liquid phase at the bottom of a stabilizer 18 preheats the feedstock by a feedstock heat exchanger and is entered into the waste heat refrigerator, a part of the discharge is extracted as product gasoline 34, and the other part enters into the waste heat refrigerator to be refrigerated and cooled and returns to the top of the absorber from the waste heat refrigerator to serve as circulating gasoline 35. The electricity generated by the residual pressure generator and the electricity generated by the waste heat generator are respectively conveyed into a grid by electric wires, and the power supply used by the compressor is led out from the grid by an electric wire.

Embodiment

A 1.2 million t/year catalytic cracking fractionation and absorption-stabilization system of a petrochemical enterprise is reformed, the waste heat refrigeration, residual pressure and waste heat power generation technology are not adopted in the original process, the cooling temperature is a circulating water temperature 40° C., as shown in FIG. 1, the energy consumption under a certain condition is compared with that of the original process after reformation:

The mixture product 23 produced about 92 t/h of gasoline, diesel oil and slurry produced by a catalytic cracking reaction device, and 31.5 t/h rich diesel oil 24 returning from the bottom of the reabsorber 10 respectively enter into the main fractionating tower 1 from the bottom and the top for distillating separation at the atmospheric pressure, the top oil gas 25 is cooled by the waste heat refrigerator 3 of main fractionating tower to 40° C., heat is extracted to serve as the refrigerator driving heat source, and the liquid phase in the naphtha tank 4 performs back flow at 40° C., 30 t/h naphtha 26 is subjected to further low temperature cooling by the waste heat refrigerator 3 of the main fractionating tower for cooling down to 20° C., and enters into the top of the absorber 9. The gas phase 32 t/h rich gas 28 in the naphtha tank 4 enters into the compressor 6 to be pressurized to 1.5 MPa, the compressed rich gas is then mixed with the rich gasoline 30 discharged from the bottom of the absorber and the desorbed gas 31 discharged from the top of the desorber 15, and the mixture is cooled by the waste heat refrigerator 7 of rich gas to 30° C. by heat extraction. The rich gas enters into the bottom of the absorber 9 with the operating pressure ranges from 1.2 to 1.4 MPa after 30° C. gas-liquid balance, the absorber intermediate heat exchangers 21 extract heat from the siding of the absorber via a cold source provided by the waste heat refrigerator 14 of stabilizer so as to keep the low temperature absorption at the temperature ranges from 25 to 35° C., the light components carrying gasoline enter into the reabsorber 10 to be absorbed by the circulating diesel oil, the 4 t/h dry gas 32 is depressurized to the atmospheric pressure via the energy extraction of the residual pressure generator 13 to be discharged for combustion, and the electricity generated by the residual pressure generator 13 is conveyed into the grid 22.

The diesel oil at the bottom of the reabsorber 10 exchanges heat with the diesel oil 27 through the diesel oil heat exchanger 11 to be heated to 210° C., and is circulated to the top of the main fractionating tower 1 as rich diesel oil 24. A diesel oil tower is arranged on the siding of the main fractionating tower 1. The diesel oil tower 2 removes the light components by refining, the 51 t/h diesel oil 27 extracted from the bottom is cooled to 130° C. by the heat exchange with the diesel oil heat exchanger 11 and is used as the waste heat source of a waste heat generator 12, the diesel oil after heat extraction is cooled to 40° C., 21 t/h product diesel oil 33 is extracted, and the rest is circulated to the reabsorber.

The liquid phase separated from the gas-liquid separation tank 8 enters into the desorber 15 with an operating pressure of 1.6 MPa to separate C2, C3 and C4 components, the desorbed gas 31 is mixed with compressed gas, heavy components enter into the stabilizer 18 with the operating pressure of 1.2 MPa to be separated, a product of liquefied petroleum gas 36 is discharged from the top, after stable gasoline at the bottom preheats the feedstock, heat is extracted from the same by a waste heat refrigerator 14 of stabilizer, 35 t/h product gasoline 34 is extracted, and the rest is cooled by the waste heat refrigerator 14 of stabilizer to 20° C. and is circulated to the top of the absorber 9. A slurry heat exchanger 5 is arranged at the bottom of the main fractionating tower 1, after cooled the high-temperature slurry from 310° C. to 250° C., 3.8 t product slurry 29 is extracted, and the rest returns to the bottom of the main fractionating tower 1.

TABLE 1

Energy consumption and output statistics of waste heat refrigerating unit

| | Waste heat refrigerator 3 of main fractionating tower | Waste heat refrigerator 7 of rich gas | Waste heat refrigerator 14 of stabilizer |
|---|---|---|---|
| Waste heat input Mkcal/h | 22800 | 2370 | 5518 |
| Refrigerating capacity KW | 400 | 600 | 350 |
| Circulating water consumption t/h | 1900 | 0 | 540 |

The generating capacity of the waste heat generator 12 is 10 KW, and the generating capacity of the residual pressure generator 13 is 300 KW.

TABLE 2

Comparison of energy consumption and emission of the original process and the energy saving process

| Statistical item | Original process | Energy saving process |
|---|---|---|
| Dry gas dosage t/h | 4281 | 4253 |
| Circulating gasoline dosage t/h | 38244 | 27930 |
| Power consumption KW | 730 | 410 |
| System heat input Mkcal/h | 15.14 | 12.13 |
| Waste heat emission Mkcal/h | 32.8 | 24.1 |
| Circulating water consumption t/h | 4124 | 3003 |
| 20% of energy is saved after system reformation, and the waste heat emission is reduced by 27% | | |

Note:

the raw material of the fractionating tower is the high-temperature material discharged from the reactor, the carried heat energy is not included in the heat input of the system, and the heat input of the fractionating tower is only included in the energy consumption of the reboiler.

The catalytic cracking fractionation and absorption-stabilization system of the oil refinery and the energy saving method provided by the present invention have been described by preferred embodiments. Apparently, those skilled in the art can make modifications or proper variations and combinations to the structures and equipment described herein without departing from the contents, spirit and scope of the present invention so as to achieve the technology of the present invention. It should be particularly noted that all similar substitutions and modifications are apparent to those skilled in the art, and these substitutions and modifications are deemed to be encompassed within the spirit, scope and contents of the present invention.

What is claimed is:

1. A catalytic cracking fractionation and absorption-stabilization system of an oil refinery, wherein heat is extracted from the top of a main fractionating tower (1) by a first waste heat refrigerator (3) to serve as a refrigerator driving heat source after heat extraction so as to cool naphtha; rich gas (28) at the top of the main fractionating tower enters into a compressor for compression, the compressed rich gas is mixed with rich gasoline (30) discharged from the bottom of an absorber and desorbed gas (31) discharged from the top of a desorber to form a mixture, and the mixture enters into a gas-liquid separation tank (8) to reduce the phase splitting temperature therein after being cooled in a second waste heat refrigerator (7); a diesel oil tower (2) is arranged on the siding of the main fractionating tower (1), after the diesel oil discharged from the bottom of the diesel oil tower (2) exchanges heat with a diesel oil heat exchanger (11), the residual waste heat is used for generating power by a waste heat generator; in an absorption-stabilization system, two absorber intermediate heat exchangers (21) serially connected are arranged on each side edge of an absorber (9) and are serially connected with a third waste heat refrigerator (14) that is driven by the waste heat of the stable gasoline by pipelines so as to extract the heat discharged by the absorber in time during absorption and control low temperature absorption of the absorber; a residual pressure generator is connected to the top of a reabsorber (10) to generate power by the medium and low residual pressure of dry gas (32) at the top; a liquid phase at the bottom of a stabilizer (18) preheats the feedstock by a feedstock heat exchanger and is entered into the third waste heat refrigerator, a part of the discharge is extracted as product gasoline (34), and the other part enters into the third waste heat refrigerator to be refrigerated and cooled and returns to the top of the absorber from the third waste heat refrigerator to serve as circulating gasoline (35); and the residual pressure generator and the third waste heat generator generate electricity which is respectively conveyed into a grid by electric wires, and the power supply used by the compressor is led out from the grid by an electric wire.

2. An energy saving method for the catalytic cracking fractionation and absorption-stabilization system of the oil refinery according to claim 1, wherein a catalytic cracking reaction product (23) and rich diesel oil (24) returning from the bottom of the reabsorber (10) enter into the main fractionating tower (1) for oil cutting according to different boiling point ranges, heat is extracted from top oil gas (25) by a waste heat refrigerator (3) of the main fractionating tower to serve as a refrigerator driving heat source, the top oil gas enters into a naphtha tank (4) after being cooled within the temperature ranges from 40 to 80° C., the liquid phase in the tank is naphtha, a part of the naphtha returns to the tower as backflow, the other part of the naphtha is cooled by the waste heat refrigerator (3) of the main fractionating tower, and naphtha (26) is cooled within the temperature ranges from solidifying point to 40° C. and then enters into the top of the absorber (9); the rich gas (28) is discharged from the naphtha tank (4) and is pressurized to 0.1 to 3 MPa in a compressor (6) to produce electricity which is led out by a compressor power supply (39) from a grid (22), and the compressed rich gas is mixed with the rich gasoline (30) at the bottom of the absorber and the desorbed gas (31) at the top of a desorber (15); a mixed gas-liquid phase enters into the third waste heat refrigerator (7) of rich gas to exchange heat within the temperature ranges from solidifying point to 40° C., the rich gas separated by the gas-liquid separation tank (8) enters into the absorber (9) from the bottom, the operating pressure of the absorber (9) is within the pressure ranges from 0.8 to 2.6 Mpa, the naphtha and the circulating gasoline at the top mainly absorb C3, C4 components in the rich gas, and the two absorber intermediate heat exchangers (21) serially connected on the side edge of the tower extract heat from the siding so as to keep the low temperature absorption of the absorber at the temperature ranges from 5 to 80° C.; light components containing the gasoline enter into the reabsorber (10) and are absorbed by a circulating diesel oil, the operating pressure of the reabsorber (10) is within the pressure ranges from 0.8 to 2.6 Mpa, the dry gas (32) is pressurized by a residual pressure generator (13) to the atmospheric pressure to be discharged, and the residual pressure generator (13) generates electricity which is conveyed into a grid (22) by a power supply (38) of residual pressure power generation; diesel oil containing rich gasoline components is discharged from the bottom of the reabsorber (10), exchanges heat with diesel oil (27) through the diesel oil heat exchanger (11) to be heated within the temperature ranges from 150 to 250° C., and is circulated to the top of the main fractionating tower (1) as rich diesel oil (24); the diesel oil tower is arranged on the siding of the main fractionating tower (1), light components are removed from the liquid phase extracted from the side of the main fractionating tower by the refining of the diesel oil tower (2), after the diesel oil (27) extracted from the bottom of the diesel oil tower (2) is cooled within the temperature ranges from 80 to 150° C. by the heat exchange with the diesel oil heat exchanger (11), with the temperature still in said range, the diesel oil can be used as the waste heat source of a waste heat generator (12), the generated electricity is conveyed into the grid (22) by a power supply (37) of waste heat power generation to supplement the power consumption, the diesel oil is cooled to 40° C. after heat extraction, a part of the diesel oil is circulated to the reabsorber, and the rest part is extracted as product diesel oil (33).

* * * * *